US005630249A

United States Patent [19]

Rebai, Jr.

[11] Patent Number: 5,630,249

[45] Date of Patent: May 20, 1997

[54] SLIDING SCREEN DOOR CLOSING DEVICE

[76] Inventor: Delbert D. Rebai, Jr., 12802 Aspenwood, Garden Grove, Calif. 92640

[21] Appl. No.: 587,107

[22] Filed: Jan. 11, 1996

[51] Int. Cl.[6] ..... E05F 1/08

[52] U.S. Cl. ..... 16/78; 16/77

[58] Field of Search ..... 16/78, 77, 75, 16/76

[56] References Cited

U.S. PATENT DOCUMENTS

| | | | |
|---|---|---|---|
| 2,992,450 | 7/1961 | Pittenger | 16/78 |
| 3,246,363 | 4/1966 | Rogas et al. | 16/78 |
| 3,480,227 | 11/1969 | Matthews | 16/78 |
| 3,502,280 | 3/1970 | Jessup et al. | 16/78 |
| 3,548,444 | 12/1970 | Jocobus et al. | 16/78 |
| 3,756,585 | 9/1973 | Mihalcheon | 16/78 |
| 4,675,938 | 6/1987 | Bundschuh | 16/78 |

*Primary Examiner*—Chuck Y. Mah

[57] ABSTRACT

A device for closing a sliding screen door is disclosed. The inventive device includes a housing mountable proximal to a sliding screen door. A retractable cable resiliently extends from the housing and couples with the sliding screen door to effect closing of the door subsequent to opening thereof.

2 Claims, 3 Drawing Sheets

FIG 1
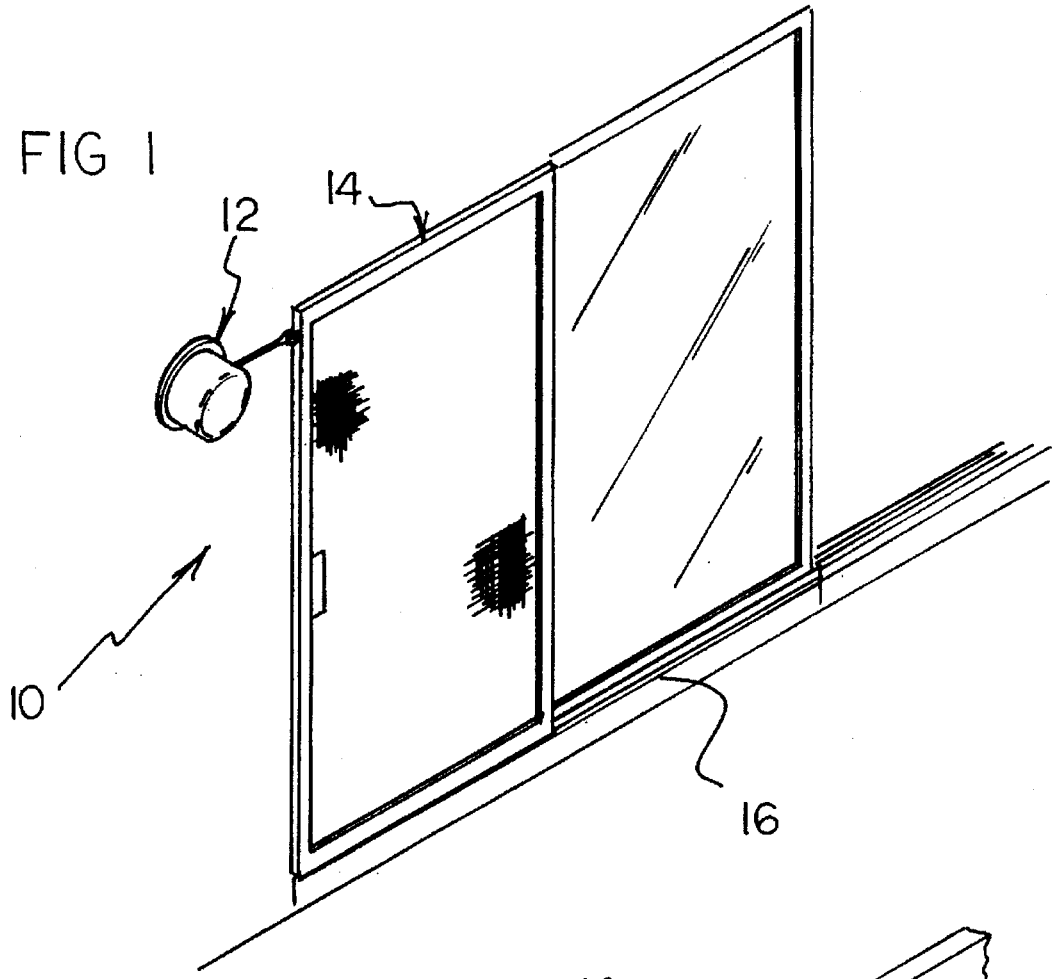
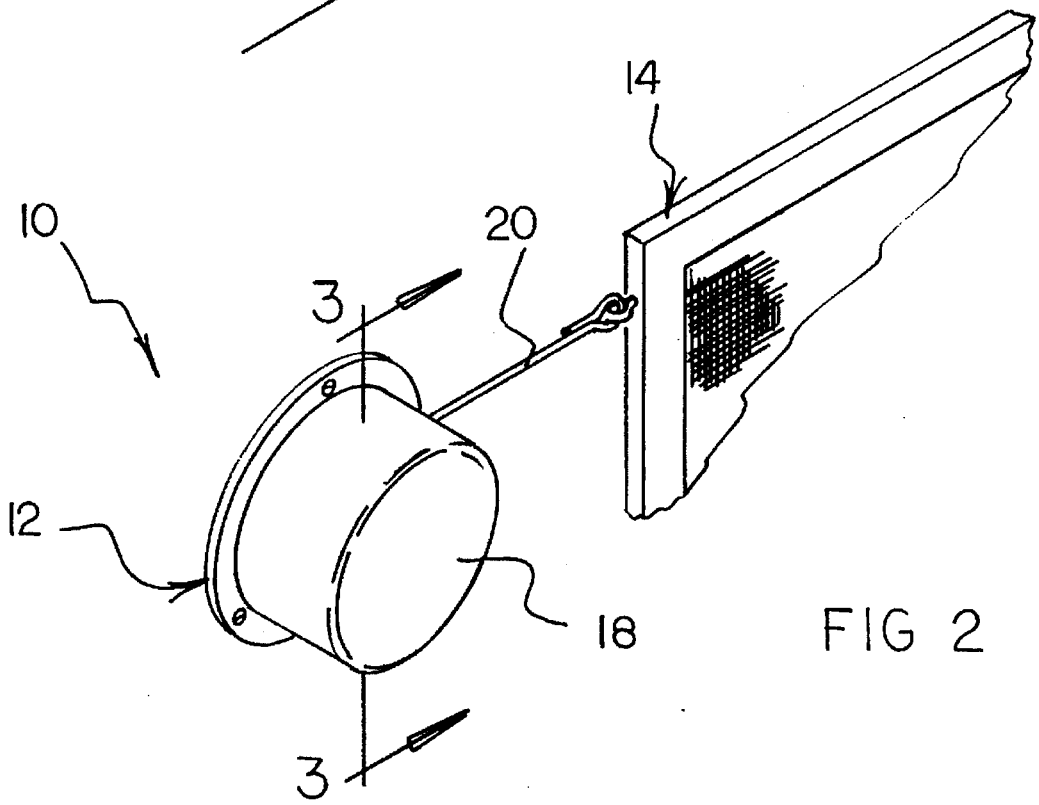
FIG 2

FIG 4
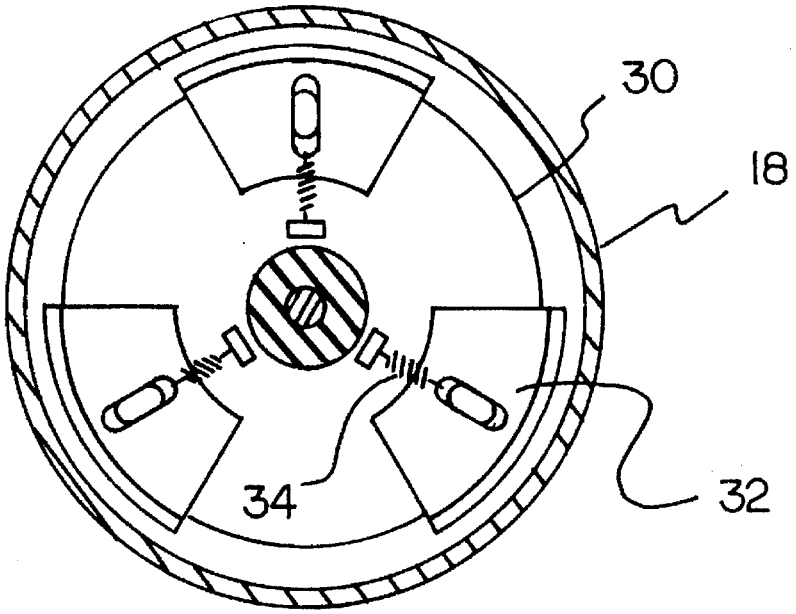
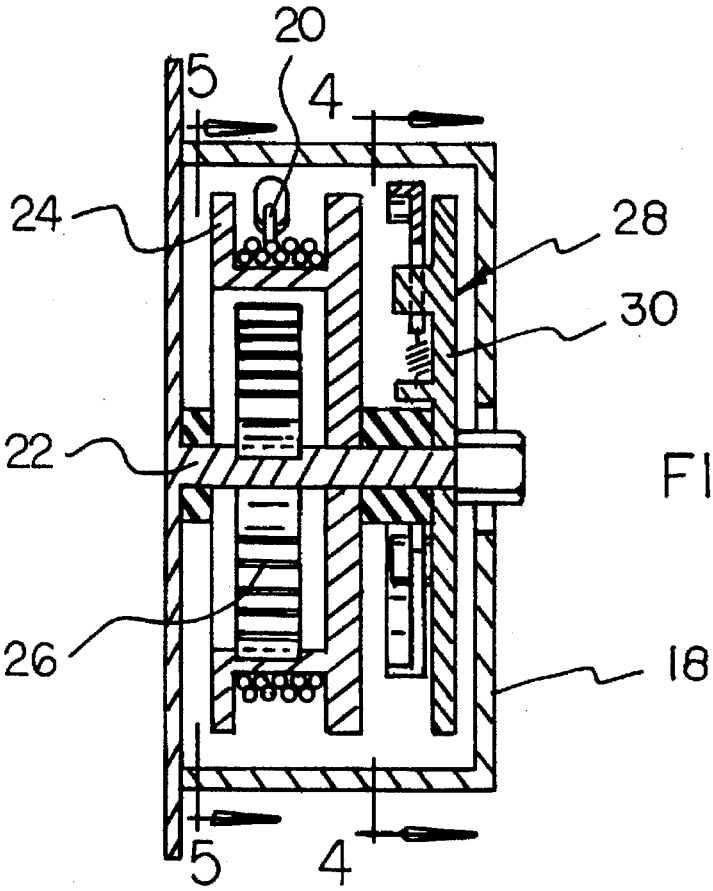
FIG 3

FIG 5
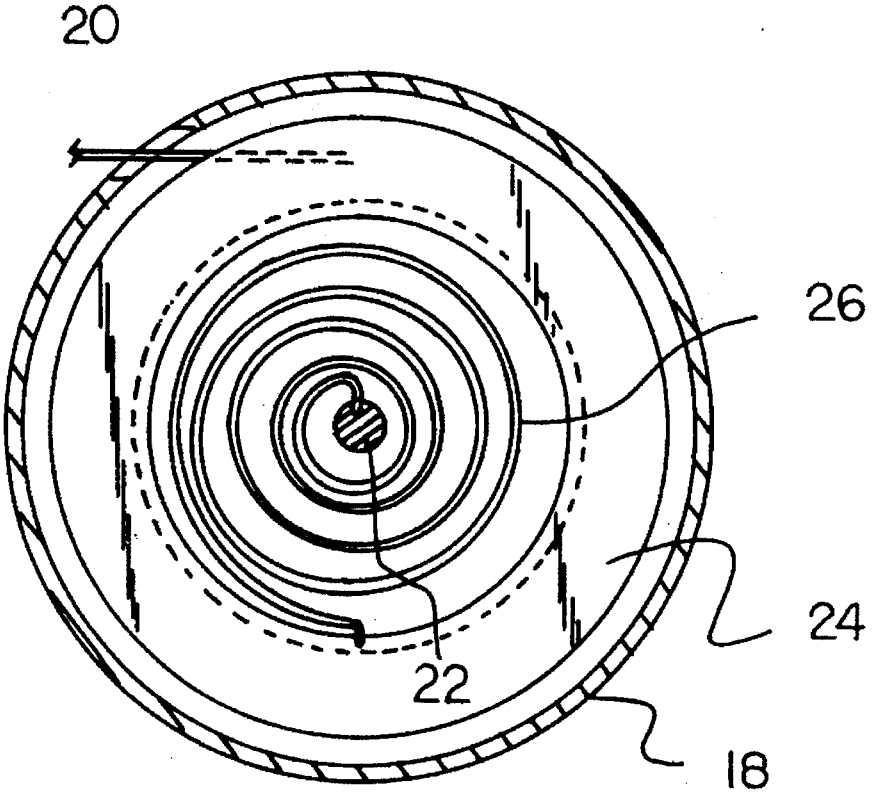
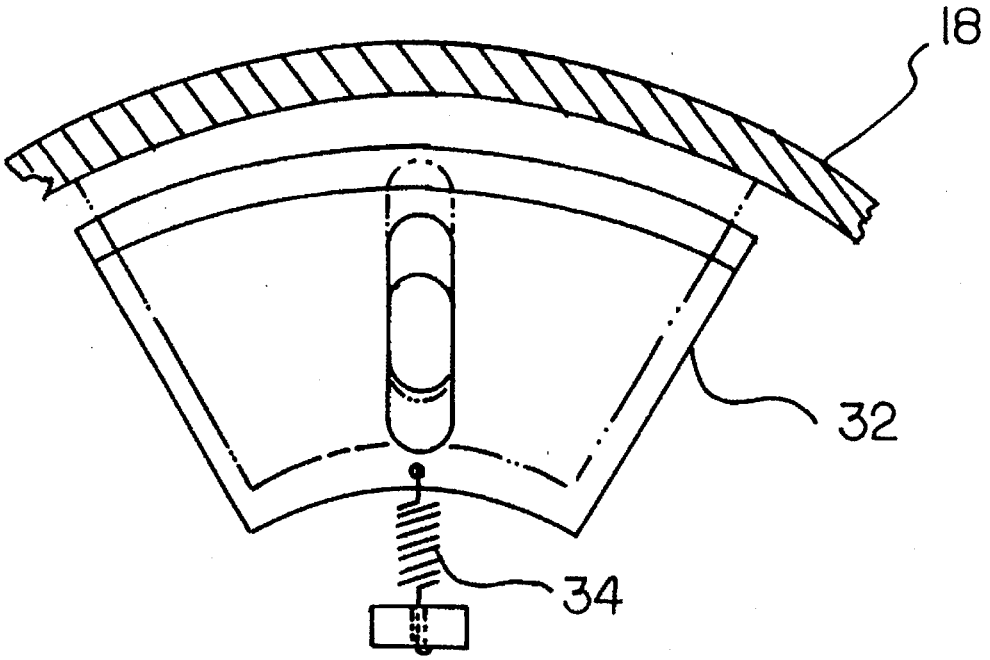
FIG 6

SLIDING SCREEN DOOR CLOSING DEVICE

BACKGROUND OF THE INVENTION

1. Field of the Invention

The present invention relates to automatic closures and more particularly pertains to a sliding screen door closing device for closing a sliding screen door.

2. Description of the Prior Art

The use of automatic closures is known in the prior art. More specifically, automatic closures heretofore devised and utilized are known to consist basically of familiar, expected and obvious structural configurations, notwithstanding the myriad of designs encompassed by the crowded prior art which have been developed for the fulfillment of countless objectives and requirements.

Known prior art automatic closures include U.S. Pat. No. 4,004,372; U.S. Pat. No. 5,131,188; U.S. Pat. No. 4,884,369; U.S. Pat. No. 3,828,393; U.S. Pat. No. 5,285,596; U.S. Pat. No. 5,247,763; and U.S. Pat. No. 4,149,295.

While these devices fulfill their respective, particular objectives and requirements, the aforementioned patents do not disclose a sliding screen door closing device for closing a sliding screen door which includes a housing mountable proximal to a sliding screen door, and a retractable cable resiliently extending from the housing and coupling with the screen door to effect closing of the door subsequent to opening thereof.

In these respects, the sliding screen door closing device according to the present invention substantially departs from the conventional concepts and designs of the prior art, and in so doing provides an apparatus primarily developed for the purpose of effecting automatic closing of a sliding screen door.

SUMMARY OF THE INVENTION

In view of the foregoing disadvantages inherent in the known types of automatic closures now present in the prior art, the present invention provides a new sliding screen door closing device construction wherein the same can be utilized for closing a sliding screen door. As such, the general purpose of the present invention, which will be described subsequently in greater detail, is to provide a new sliding screen door closing device apparatus and method which has many of the advantages of the automatic closures mentioned heretofore and many novel features that result in a sliding screen door closing device which is not anticipated, rendered obvious, suggested, or even implied by any of the prior art automatic closures, either alone or in any combination thereof.

To attain this, the present invention generally comprises a device for closing a sliding screen door. The inventive device includes a housing mountable proximal to a sliding screen door. A retractable cable resiliently extends from the housing and couples with the sliding screen door to effect closing of the door subsequent to opening thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and. scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sliding screen door closing device apparatus and method which has many of the advantages of the automatic closures mentioned heretofore and many novel features that result in a sliding screen door closing device which is not anticipated, rendered obvious, suggested, or even implied by any of the prior art tool guides, either alone or in any combination thereof.

It is another object of the present invention to provide a new sliding screen door closing device which may be easily and efficiently manufactured and marketed.

It is a further object of the present invention to provide a new sliding screen door closing device which is of a durable and reliable construction.

An even further object of the present invention is to provide a new sliding screen door closing device which is susceptible of a low cost of manufacture with regard to both materials and labor, and which accordingly is then susceptible of low prices of sale to the consuming public, thereby making such sliding screen door closing devices economically available to the buying public.

Still yet another object of the present invention is to provide a new sliding screen door closing device which provides in the apparatuses and methods of the prior art some of the advantages thereof, while simultaneously overcoming some of the disadvantages normally associated therewith.

Still another object of the present invention is to provide a new sliding screen door closing device for effecting closing of a sliding screen door.

Yet another object of the present invention is to provide a new sliding screen door closing device which includes a housing mountable proximal to a sliding screen door, and a retractable cable resiliently extending from the housing and coupling with the sliding screen door to effect closing of the door subsequent to opening thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a sliding screen door closing device according to the present invention in use.

FIG. 2 is an enlarged isometric illustration of a portion of the present invention.

FIG. 3 is a cross-sectional view taken along line 3—3 of FIG. 2.

FIG. 4 is a cross-sectional view taken along line 4—4 of FIG. 3.

FIG. 5 is a cross-sectional view taken along line 5—5 of FIG. 4.

FIG. 6 is an enlarged cross-sectional view of a portion of the present invention.

DESCRIPTION OF THE PREFERRED EMBODIMENT

With reference now to the drawings, and in particular to FIGS. 1–6 thereof, a new sliding screen door closing device embodying the principles and concepts of the present invention and generally designated by the reference numeral 10 will be described.

More specifically, it will be noted that the sliding screen door closing device 10 comprises a closure means 12 for effecting movement of a sliding screen door 14 along a linear track 16 in a predetermined direction so as to effect closing of the sliding screen door subsequent to opening thereof. By this structure, an individual effecting opening of the sliding screen door 14 can simply release the sliding screen door to allow the closure means 12 to automatically reposition the sliding screen door in a desired orientation, as shown in FIG. 1 of the drawings.

Referring now to FIGS. 2 through 6 wherein the present invention 10 is illustrated in detail, it can be shown that the closure means 12 of the present invention 10 preferably comprises a housing 18 which can be mounted to a portion of a building adjacent to the sliding screen door 14. A cable 20 is stored within the housing 18 and can be resiliently extended therefrom during operation of the sliding screen door 14. The cable 20 extends from the housing 18 and is coupled to a portion of the sliding screen door 14 such as is shown in FIG. 2 of the drawings. By this structure, an opening of the sliding screen door 14 will effect extension of cable 20 from the housing 18, whereby a releasing of the sliding screen door 14 will result in a resilient retraction of the cable 20 into the housing 18 to effect closing of the sliding screen door 14.

As shown in FIGS. 3 and 5, a center axle 22 extends through the housing 18 and rotatably mounts a spool 24 within the housing. The cable 20 is spirally wound about the spool 24 when stored within the housing 18. To effect resilient biasing of the cable 20 into the housing 18 as described above, a spiral spring 26 is interposed between the spool 24 and the center axle 22. In other words, the spiral spring 26 is wrapped about the center axle 22 secured thereto and is further secured to an interior surface of the spool 24, whereby extension of the cable 20 from the spool will result in a tightening or tensioning of the spiral spring 26 tending to effect biasing of the cable 20 back into the housing 18.

Referring now to FIGS. 4 and 6, it can be shown that the closure means 12 of the present invention 10 may further comprise a centrifugal brake means 28 for limiting a rotational speed of the spool 24 during use of the device 10. To this end, the centrifugal brake 28 preferably comprises a plate 30 rotatably mounted about the center axle 22 and secured. to the spool 24 so as to rotate therewith. A plurality of arcuate brake pads 32 are slidably mounted to the plate 30 and positioned in a radially spaced orientation relative to one another. Each of the arcuate brake pads 32 is inwardly radially biased towards the center axle 22 by a retaining spring 34 extending between the plate 30 and the respective arcuate brake pad 32. By this structure, a rotation of the plate 30 with the spool 24 will effect centrifugal acceleration of the arcuate brake pads 32 towards an interior surface of the housing 18, thereby engaging the same and retarding rotational motion of the plate 30 and the spool 24. Such radially outward motion of the arcuate brake pads 32 in response to the centrifugal acceleration thereof during rotation of the plate 30 is illustrated in FIG. 6 for a single arcuate brake pad.

In use, the sliding screen door closing device 10 according to the present invention can be easily utilized to effect automatic closing of a sliding screen door such as the sliding screen door 14 illustrated in FIG. 1 of the drawings. The present invention 10 thus operates to ensure that the sliding screen door 14 remains closed so as to preclude an entrance of dirt, debris, or insects into an associated building structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A sliding screen door closing device comprising:

a closure means for effecting movement of a sliding screen door along a linear track in a predetermined direction so as to effect closing of the sliding screen door subsequent to opening thereof, the closure means comprises a housing mountable to a portion of a building adjacent to a sliding screen door; a cable stored within the housing which can be resiliently extended therefrom, the cable extending from the housing and being couplable to a portion of the sliding screen door, whereby an opening of the sliding screen door will effect extension of the cable from the housing, with a releasing of the sliding screen door resulting in a resilient retraction of the cable into the housing to effect closing of the sliding screen door, the closure means further comprises a center axle extending through the housing; a spool rotatably mounted within the housing about the center axle, with the cable being spirally wound about the spool when stored within the housing; a spiral spring interposed between the spool and the center axle, the spiral spring being wrapped about the center axle secured thereto, the spiral spring being further secured to an interior surface of the spool, whereby extension of the cable from the spool will result in a tightening of the spiral spring tending to effect biasing of the cable back into the housing and onto the spool, the closure means further comprises a centrifugal brake means for limiting a rotational speed of the spool, the centrifugal brake means comprises a plate rotatably mounted about the center axle and secured to the spool so as to rotate therewith; a plurality of arcuate brake pads slidably mounted to the plate and positioned in a circumferentially spaced orientation relative to one another, a plurality of retaining springs, with each of the arcuate brake pads being inwardly radially biased towards the center axle by an individual one of the retaining springs extending between the plate and the respective arcuate brake pad such that a rotation of the plate with the spool will effect centrifugal acceleration of the arcuate brake pads towards an interior surface of the housing such that the brake pads engage the interior surface of the housing to retard rotational motion of the plate and the spool relative to the housing.

2. A sliding screen door closing device comprising:

a building having an opening directed therethrough;

a linear track mounted to the building along an edge of the opening;

a sliding screen door slidably mounted along the linear track; and a closure means for effecting movement of a sliding screen door along the linear track in a predetermined direction so as to effect closing of the sliding screen door subsequent to opening thereof, the closure means comprises a housing mountable to a portion of the building adjacent to the opening; a cable stored within the housing which can be resiliently extended therefrom, the cable extending from the housing and being coupled to a portion of the sliding screen door, whereby an opening of the sliding screen door will effect extension of the cable from the housing, with a releasing of the sliding screen door resulting in a resilient retraction of the cable into the housing to effect closing of the sliding screen door, the closure means further comprises a center axle extending through the housing; a spool rotatably mounted within the housing about the center axle, with the cable being spirally wound about the spool when stored within the housing; a spiral spring interposed between the spool and the center axle, the spiral spring being wrapped about the center axle secured thereto, the spiral spring being further secured to an interior surface of the spool, whereby extension of the cable from the spool will result in a tightening of the spiral spring tending to effect biasing of the cable back into the housing and onto the spool, the closure means further comprises a centrifugal brake means for limiting a rotational speed of the spool, the centrifugal brake means comprises a plate rotatably mounted about the center axle and secured to the spool so as to rotate therewith; a plurality of arcuate brake pads slidably mounted to the plate and positioned in a circumferentially spaced orientation relative to one another, a plurality of retaining springs, with each of the arcuate brake pads being inwardly radially biased towards the center axle by an individual one of the retaining springs extending between the plate and the respective arcuate brake pad such that a rotation of the plate with the spool will effect centrifugal acceleration of the arcuate brake pads towards an interior surface of the housing such that the brake pads engage the interior surface of the housing to retard rotational motion of the plate and the spool relative to the housing.

* * * * *